US007770549B2

(12) United States Patent
Mediatore et al.

(10) Patent No.: US 7,770,549 B2
(45) Date of Patent: Aug. 10, 2010

(54) COMPRESSION REDUCTION DEVICE FOR PISTON SPARK IGNITION INTERNAL COMBUSTION ENGINES WITH REMOVABLE CYLINDERS

(76) Inventors: Richard E. Mediatore, 1096 Woodman Dr., Worthington, OH (US) 43085-2965; Michael R. Mediatore, 117 Spicewood La., Powell, OH (US) 43065-9286

( * ) Notice: Subject to any disclaimer, the term of this patent is extended or adjusted under 35 U.S.C. 154(b) by 76 days.

(21) Appl. No.: 12/165,044

(22) Filed: Jun. 30, 2008

(65) Prior Publication Data

US 2009/0320804 A1 Dec. 31, 2009

(51) Int. Cl.
*F02B 75/04* (2006.01)

(52) U.S. Cl. ..... 123/48 R; 123/195 R

(58) Field of Classification Search ..... 123/48 R, 123/48 C, 78 R, 78 C, 195 R
See application file for complete search history.

(56) References Cited

U.S. PATENT DOCUMENTS

| | | | | |
|---|---|---|---|---|
| 2,525,131 | A | 10/1950 | Hallett | 123/48 R |
| 5,509,382 | A | 4/1996 | Noland | 123/66 |
| 6,409,178 | B1 | 6/2002 | Raden et al. | 277/592 |

FOREIGN PATENT DOCUMENTS

| | | | |
|---|---|---|---|
| JP | 59003149 | A | 1/1984 |

*Primary Examiner*—Noah Kamen

(57) ABSTRACT

A compression reduction device for internal combustion, spark ignition, piston engines with removable cylinders. The device is installed under each cylinder of an engine to reduce the engine's compression ratio, thereby allowing the safe use of lower octane unleaded fuel. The device is a metal or composite part shaped to match the cylinder-to-crankcase mount. The engine cylinders are unbolted and raised slightly to allow placement of the invention between the cylinder and it's mounting on the engine crankcase. After reattaching, the top of the cylinder has effectively been raised, relative to the top of the piston, thereby reducing the cylinder's compression ratio.

1 Claim, 2 Drawing Sheets

High Compression Engine (Piston at bottom of intake stroke/ beginning of compression stroke)

(Piston at top of compression stroke)

Same Engine with Compression lowered using the Invention (Piston at bottom of intake stroke/ beginning of compression stroke)

(Piston at top of compression stroke)

COMPRESSION REDUCTION DEVICE FOR PISTON SPARK IGNITION INTERNAL COMBUSTION ENGINES WITH REMOVABLE CYLINDERS

BACKGROUND OF THE INVENTION

Technical Field of the Invention

This invention relates to the lowering of the compression ratio of spark ignition internal combustion piston engines that have removable cylinders for the purpose of allowing the use of less expensive, lower octane unleaded fuels.

Spark ignition engines draw a fuel-air mixture into each cylinder combustion chamber as the piston moves downward on the intake stroke. This combustible mixture of fuel-air is then compressed as the piston moves upward to the top of its compression stroke. Near the top of the stroke the sparkplug fires and ignites the fuel-air mixture. The resulting gas combustion forces the piston down on its power stroke. Engine power and efficiency are increased as the engine design compression ratio increases. The compression ratio is the volume of the fuel-air mixture in the cylinder with the piston at the bottom of its travel compared to the volume of the fuel-air mixture with the piston at the top of its travel. Maximum compression ratio is limited by the fuel's octane rating, which prevents the fuel from igniting prematurely (auto-ignition), and by the internal design of the cylinder head and piston.

Octane rating is a measurement of the resistance to auto-ignition of the gasoline, and other fuels, used in spark ignition internal combustion engines. If auto-ignition occurs prior to the piston reaching the top of its upward compression stroke it can be extremely destructive to an engine's mechanical components. The octane rating of fuel can be raised by several methods, one is the additional refining of the fuel stock but this adds significant cost to the fuel. The second method, usually used in conjunction with the first, is to add tetraethyl lead to the fuel, however this lead additive is extremely poisonous and environmentally harmful. Engines are typically designed with the highest compression ratio possible, based on available octane fuels, for maximum performance. This invention reduces the compression ratio of existing engines, allowing them to use a lower octane fuel, while only slightly reducing power. In many applications, this loss of power is more than offset by economic, ecological and logistic benefits.

Many modern vehicles are equipped with high compression engines that provide higher performance than older lower compression engines. However, there is a need today, generated by cost, logistic and environmental concerns to allow these engines to burn lower octane lead free automotive fuels. One of the potential applications of the invention is in current high performance piston engine aircraft where a four or six cylinder, air-cooled, engine requires 100 octane leaded fuel. Aircraft engines typically operate at very high power levels, consuming three to five times the amount of fuel compared to most land vehicles, making any improvement in fuel consumption especially significant.

In the 1980 to 2000 year time frame, a number of organizations, including the Federal Aviation Administration, thoroughly examined the use of low octane unleaded automotive fuels in older low compression aircraft engines. They concluded that the automotive fuels could be used safely and effectively in these engines. The invention is useable on any engine with removable cylinders and will allow the economical adjustment of engine compression ratio, permitting the use of lower octane (87) unleaded (automotive) fuel, in an engine originally designed to use high octane leaded aviation fuel, thereby substantially reducing the engine's operating costs.

SUMMARY OF THE INVENTION

The Compression Reduction Device For Any Piston Spark Ignition Internal Combustion Engine With Removable Cylinders is an invention designed to lower the compression ratio of the engine on which it is installed. The invention is installed between each engine cylinder and it's mounting base on the engine crankcase. This effectively moves the cylinder away from the crankcase reducing the engine's compression ratio and allowing the engine to operate on lower octane fuel. The number of invention devices needed to modify an engine is equal to the number of cylinders in the engine, e.g.; a six-cylinder engine would require six devices. The invention, in one embodiment, is a metal part, approximately one eighth (0.125) of an inch thick (specific thicknesses is determined for each engine application) shaped to match the lower flange of the engine cylinder, and may be in two or more pieces. The engine cylinder is unbolted, and raised slightly, to allow placement of the invention between the cylinder and it's mounting on the engine crankcase. After reattaching, the top of the cylinder has effectively been raised, relative to the top of the piston, thereby reducing the cylinder's compression ratio. This procedure is then repeated for all of the engine's cylinders, and may necessitate minor adjustments, or modifications to other engine components to compensate for the slight change in cylinder and cylinder head position relative to the crankcase. The invention is produced to match the specific profile of the cylinder-to-crankcase mounting design for the intended engine.

Advantages of the invention are that it is a low cost, simple to install, and easily reversible method of lowering the compression ratio of an engine. Installation of the invention requires minimal disassembly and modification of the engine, and requires no significant or costly engine mechanical changes. If desired, the invention can be easily removed and the engine restored to its original high compression configuration. The cost advantages of being able to use a lower octane unleaded (automotive) fuel are quite significant. The environmental advantage of not using a leaded fuel is also very significant. There is an added benefit of the reduced logistical effort needed to produce, transport, and store a unique high-octane fuel for a limited number of users. Some increase in modified engine longevity may be expected, as a lower compression ratio reduces stress levels on some of the engine's internal components.

The invention solves the problem of how to use low octane unleaded fuels in modern high performance engines without costly major mechanical modification to the engine. Engines can be designed with lower compression ratios, but the invention allows for the economical conversion of thousands of existing engines to use lower octane unleaded automotive grade fuels.

The object of the invention is to adapt existing engines that are required to use high octane leaded fuels to safely and effectively use lower octane, low cost unleaded fuels. There are no known devices or techniques in existing technology with the simplicity and economy of the invention that can accomplish this objective.

DETAILED DESCRIPTION OF THE INVENTION

Figure 1:
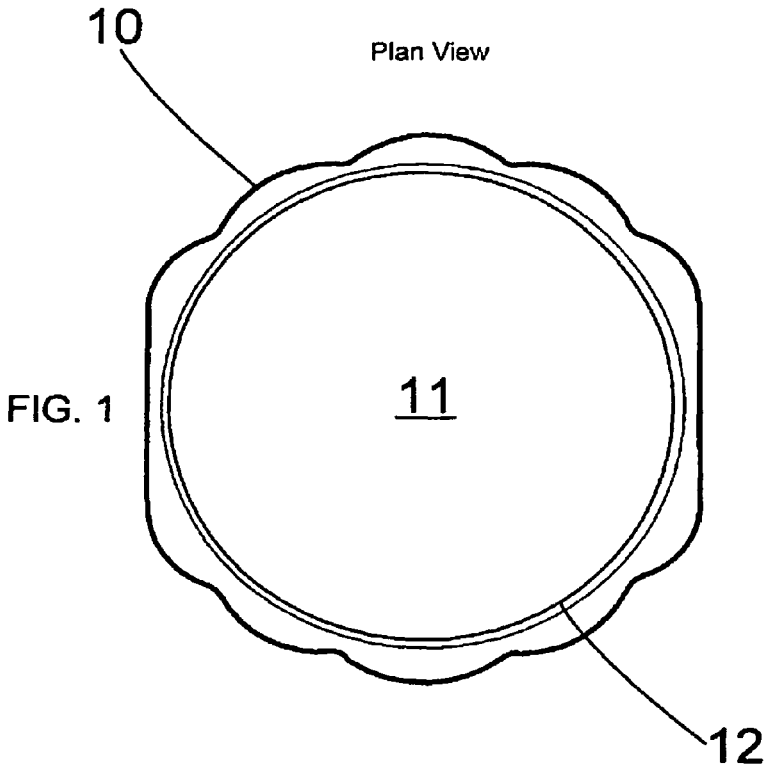
FIG. 1 illustrates the invention. It is shaped to match the design of the engine cylinder-to-crankcase mounting and to fit between the cylinder base and the crankcase.
Figure 2:
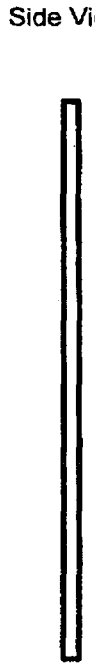
FIG. 2 shows a side view and FIG. 3 shows an end view of the invention.
Figure 3:
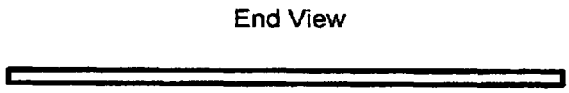

FIGS. 1, 2 and 3 are a three dimensional view of the invention 10, a large hole 11 in the center to allow the invention to be placed around the cylinder barrel and a grove 12 on each side of the invention to accommodate oil seals originally installed on the engine. The large diameter center hole 11 is sized slightly larger than the cylinder barrel outside diameter to allow the invention to be placed around the barrel.

The invention 10, in one embodiment, is fabricated from metal plate or sheet stock and machined to the cylinder mount outside dimensions with a large hole 11 cut in the center that is slightly larger than outside diameter of the engine cylinder barrel. Two semicircular grooves 12 are machined around the large opening to accommodate oil seals between the cylinder and engine crankcase. These oil seals may consist of O-ring oil seals already on the engine.

Figure 4:
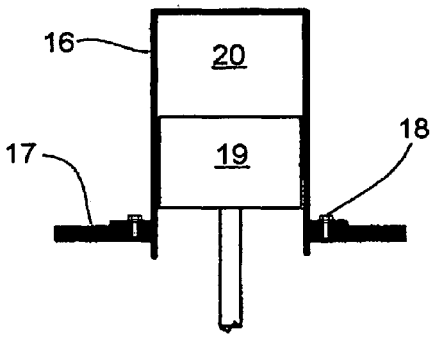
FIG. 4 shows a high compression engine cylinder with the piston at the bottom of its intake stroke (at the beginning of it's compression stroke).
Figure 5:
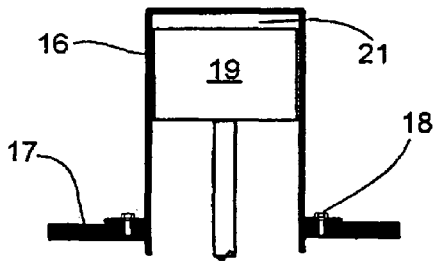
FIG. 5 shows the engine cylinder of FIG. 4 with the piston at the top of its compression stroke.

FIG. 4 depicts an unmodified engine cylinder 16 attached to the engine crankcase 17 with fasteners 18. The engine piston 19 is shown at the bottom of its intake stroke (the beginning of the compression stroke) with the ingested air-fuel mixture in the combustion chamber 20 above the piston. The piston then rises, compressing the air-fuel mixture to a volume many times smaller than at the beginning of the compression stroke. FIG. 5 shows the cylinder 16 with the piston 19 at the top of its compression stroke with the air-fuel mixture compressed in the combustion chamber volume 21 above the piston 19. Near this point the mixture is ignited and the engine enters its power stroke. The engine compression ratio is the combustion chamber volume 20 of FIG. 4 divided by the combustion chamber volume 21 of FIG. 5.

Figure 6:
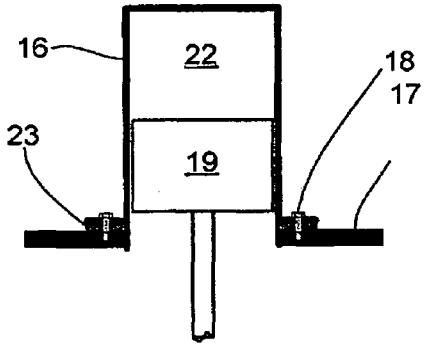
FIG. 6 shows an engine cylinder with the invention installed, and the piston at the bottom of its intake stroke (at the beginning of it's compression stroke).
Figure 7:
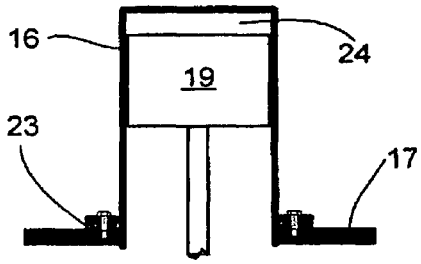
FIG. 7 shows the engine cylinder of FIG. 6 with the piston at the top of its compression stroke.

FIG. 6 shows an engine cylinder 16 attached to the engine crankcase 17 with fasteners 18 and the invention 23 installed between the cylinder 16 and the engine crankcase 17, raising the top of the cylinder 16 higher above the crankcase 17 by the thickness of the invention 23. The engine piston 19 is at the bottom of its intake stroke (the beginning of the compression stroke). The ingested air-fuel mixture is in the combustion chamber volume 22 above the piston 19. The piston then rises, compressing the air-fuel mixture to a volume many times smaller than at the beginning of the compression stroke. FIG. 7 shows cylinder 16 with the piston 19 at the top of its compression stroke with the air-fuel mixture compressed in the combustion chamber volume 24 above the piston 19. Near this point the mixture is ignited and the engine enters its power stroke. Since the cylinder 16 has been raised in height by invention 23, the combustion chamber volume 22 of FIG. 6 and the combustion chamber volume 24 of FIG. 7 are both larger than they would be without the invention 23. Because the increase in cylinder height proportionately changes the volume of the combustion chamber 24 more than it does the volume of combustion chamber 22 this reduces the engine compression ratio, which is the ratio of combustion chamber volume 22 divided by combustion chamber volume 24.

To install the invention, the engine cylinder is unbolted, and raised slightly, to allow placement of the invention, between the cylinder and it's mounting on the engine crankcase. After reattaching, the top of the cylinder has effectively been raised, relative to the top of the piston, thereby reducing the cylinder's compression ratio. This procedure is then repeated for all the engine's cylinders, and may necessitate minor adjustments, or modifications to other engine components to compensate for the slight change in cylinder and cylinder head position relative to the crankcase. The invention, placed under every cylinder of the engine, allows the engine to safely consume lower octane unleaded fuel.

What is claimed is:

1. A compression reduction device placed between an internal combustion piston engine cylinder and it's mounting base on the engine crankcase that increases the height of the cylinder above it's mounting base, causing the combustion chamber volume to increase, thereby lowering the compression ratio of the engine, wherein said device is without cylinder to crankcase fastener holes.

* * * * *